US005752353A

United States Patent [19]

Koenig et al.

[11] Patent Number: 5,752,353

[45] Date of Patent: May 19, 1998

[54] DRYWALL-TRIMMING ARTICLE HAVING CURVED SURFACE COVERED WITH DISCRETE FIBERS

[75] Inventors: Joseph Koenig, Downers Grove; Joseph M. Koenig, Jr., Linconlwood, both of Ill.

[73] Assignee: Trim-Tex, Inc., Lincolnwood, Tex.

[21] Appl. No.: 757,113

[22] Filed: Dec. 2, 1996

[51] Int. Cl.[6] ..... E04B 2/00

[52] U.S. Cl. ..... 52/255; 52/257; 52/287.1; 52/288.1; 52/417

[58] Field of Search ..... 52/255, 257, 287.1, 52/288.1, 417

[56] References Cited

U.S. PATENT DOCUMENTS

| | | | |
|---|---|---|---|
| Re. 34,547 | 2/1994 | Weldy | 52/257 X |
| 2,181,530 | 11/1939 | Davenport . | |
| 2,234,701 | 3/1941 | Lyman . | |
| 2,314,523 | 3/1943 | Speer . | |
| 2,796,641 | 6/1957 | Wollaeger | 52/255 |
| 2,862,264 | 12/1958 | Perna . | |
| 3,090,087 | 5/1963 | Miller . | |
| 4,313,991 | 2/1982 | Lamb . | |
| 4,722,153 | 2/1988 | Hardy | 52/255 |
| 4,835,925 | 6/1989 | Hoffmann, Sr. . | |
| 4,863,774 | 9/1989 | Tucker . | |
| 4,876,837 | 10/1989 | Kelly et al. . | |
| 4,977,718 | 12/1990 | Hoffmann, Sr. . | |
| 5,131,198 | 7/1992 | Ritchie et al. . | |
| 5,138,810 | 8/1992 | Kartler | 52/255 X |
| 5,418,027 | 5/1995 | Conboy . | |
| 5,486,394 | 1/1996 | Stough | 52/417 X |
| 5,508,078 | 4/1996 | Stalnaker | 52/287.1 X |
| 5,531,051 | 7/1996 | Chenier, Jr. et al. | 52/255 |
| 5,544,463 | 8/1996 | Bergin . | |
| 5,613,335 | 3/1997 | Rennich et al. | 52/255 |

FOREIGN PATENT DOCUMENTS

| | | |
|---|---|---|
| 18015/29 | 9/1929 | Australia . |
| 153625 | 10/1953 | Australia . |

OTHER PUBLICATIONS

U.S. Defensive Publication No. T-887,014 to Overbay et al. (abstract and drawing sheets).

Trim-Tex, Rigid Vinyl Drywall Accessories, (1996). Catalog at pp. 17 through 26 (1996).

*Primary Examiner*—Wynn E. Wood

*Attorney, Agent, or Firm*—Rockey, Milnamow & Katz, Ltd.

[57] ABSTRACT

For trimming a drywall corner, a drywall-trimming article has an elongate portion and two flange portions, which are extruded unitarily with the elongate portion from polyvinyl chloride. The elongate portion has an arcuate profile. Each flange portion has an array of apertures. One of the convex and concave surfaces defined by the central portion is covered substantially with discrete fibers, which adhere to the substantially covered surface but which do not cover the remaining surfaces of the central portion and of the flange portions. Such adhering fibers facilitate application of a coat of paint and texturization of the coat of paint over the substantially covered surface without separating the inner surfaces of the flange portions from the underlying drywall by any appreciable thicknesses due to such adhering fibers. The apertures are substantially free of such adhering fibers so that drywall-finishing material, when pressed onto the outer surfaces of the flange portions, can be thus pressed through the apertures, into intimate contact with the underlying drywall, without intrusion of said adhering fibers that could interfere with bonding between such material pressed therethrough and the underlying drywall.

17 Claims, 2 Drawing Sheets

DRYWALL-TRIMMING ARTICLE HAVING CURVED SURFACE COVERED WITH DISCRETE FIBERS

TECHNICAL FIELD OF THE INVENTION

This invention pertains to a drywall-trimming article, such as a corner bead, for trimming a drywall corner. Being convex or concave, an outer surface of an elongate portion of the drywall-trimming article is covered substantially with discrete fibers, which adhere to the substantially covered surface but not to an inner surface of a flange portion of the drywall-trimming article. Such adhering fibers facilitate application of a coat of paint and texturization of the coat of paint over the substantially covered surface without separating the inner surface of the flange portion from the underlying drywall by any appreciable thickness due to such adhering fibers. If the flange portion has apertures, the fibrous material does not block the apertures, whereby drywall-finishing material, when pressed onto an outer surface of the flange portion, can be thus pressed through the apertures, into intimate contact with the underlying drywall, without intrusion of such adhering fibers that could interfere with bonding between such material pressed therethrough and the underlying drywall.

BACKGROUND OF THE INVENTION

Typically, a corner bead for trimming a drywall corner has a central portion with two lateral edges and two flange portions, each extending from one of the lateral edges of the central portion. It is known to make a corner bead from paper, plastic, such as polyvinyl chloride, or metal, such as galvanized steel, so as to have unitary central and flange portions. Typically, if the corner bead is extruded from polyvinyl chloride, the flange portions have thicknesses in a range from about 0.035 inch to about 0.050 inch. The flange portions may be initially attached to the underlying drywall via staples or via a sprayed-on adhesive.

Moreover, it is known to provide the flange portions with an array of apertures, either circular holes or elongate slots, whereby drywall-finishing material, joint cement, or like material, when pressed onto the outer surfaces of the flange portions when the corner bead is used, can be thus pressed through the apertures, into intimate contact with the underlying drywall. When pressed through the apertures, into intimate contact therewith, such material bonds with and helps to attach the corner bead to the underlying drywall.

Commonly, the central portion has an arcuate profile and defines a convex surface and a concave surface, whereupon one of the convex and concave surfaces becomes an outer surface when the corner bead is used. If the concave surface has a large radius, such as a radius within a range from about 0.375 inch to about 1.5 inches, it is known to refer to the corner bead as a "bullnose" corner bead.

Weldy U.S. Pat. No. Re. 34,547 discloses various corner beads, two-way corners, and three-way corners of related interest. Having a central portion with an arcuate profile and having two flange portions, each branch of a two-way or three-way corner is similar to a short length of a corner bead, as discussed above.

As exemplified in Australian Pat. Specification No. 153,625, circa 1953, and in Ritchie et al. U.S. Pat. No. 5,131,198, it is known to cover a corner bead, which is made of plastic or metal, with a paper layer extending beyond the flange portions of the corner bead. The Ritchie et al. patent discloses a protective coating, which contains an acrylic resin and which is applied over the paper layer where the paper layer covers the central portion of the corner bead, before the corner bead is used.

Conboy U.S. Pat. No. 5,418,027 discloses a plastic tape for taping a wallboard joint. The plastic tape has a center segment, which is rolled or embossed so as to facilitate bending or folding of the plastic tape, and has discrete fibers adhering to both of its expansive surfaces. The plastic tape has a thickness ranging from about 0.015 inch to about 0.020 inch, preferably about 0.017 inch. Being known as floc, the fibers can be nylon, rayon, polyester, cotton or other cellulose, or other similar fibers or combinations of fibers and have preferred lengths ranging from about 0.005 inch to about 0.030 inch. The fibers are used to adhere a taping compound to the plastic tape.

Bergin U.S. Pat. No. 5,544,463 discloses a corner bead of related interest. The corner bead, which is described as prefinished, has a recessed face, which is defined by the joints where the central portion and the flanged portions are joined, and a veneer strip, which is configured to fit into the recessed face. The veneer strip may be formed of wood, foils, metals, or plastics or a plastic or enamel veneer is used.

This invention has resulted from ongoing efforts to improve drywall-trimming articles, particularly but not exclusively corner beads and particularly but not exclusively drywall-trimming articles made from polymeric materials, such as polyvinyl chloride.

SUMMARY OF THE INVENTION

This invention provides improvements in a drywall-trimming article having an elongate portion, which has two lateral edges, and a flange portion, which is unitary with the elongate portion. Having an arcuate profile, the elongate portion defines a convex surface and a concave surface, one of which becomes an outer surface when the drywall-trimming article is used. Having two opposite surfaces, one of which becomes an inner surface when the drywall-trimming article is used, the flange portion extends from one of the lateral edges of the elongate portion.

As contemplated by this invention, whichever of the convex and concave surfaces becomes an outer surface when the drywall-trimming article is used is covered substantially with discrete fibers, which adhere to the substantially covered surface but which do not cover any substantial part of whichever of the opposite surfaces of the flange portion becomes an inner surface when the drywall-trimming article is used. Such adhering fibers facilitate application of a coat of paint and texturization of the coat of paint over the substantially covered surface without separating the inner surface of the flange portion from the underlying drywall by any appreciable thickness due to such adhering fibers.

A so-called "knocked-down" finish is a texturized finish that results when a painter applies a thick coat of paint with a brush or a roller or with a sprayer, rakes the applied coat of paint with a toothed or serrated tool, and skims raised regions on the raked coat of paint with a straight-edged blade, whereby those regions are regarded as "knocked-down". If the outer surface of the central portion were not covered substantially with such adhering fibers, it would be more difficult for a painter to texturize a coat of paint covering the outer surface of the central portion so as to conform to adjacent painted areas, particularly but not exclusively if a so-called "knocked-down" finish is desired.

Since the flange portion could have a thickness in a range from about 0.035 inch to about 0.050 inch, and since such adhering fibers could add an additional thickness from about 0.005 inch to about 0.030 inch or more to each covered surface, it would be highly undesirable for the inner surface of the flange portion to be also covered with such adhering fibers. If the inner surface of the flange portion were separated from the underlying drywall by any appreciable thickness due to such adhering fibers, it would require more time, labor, and drywall-finishing material to finish the flange portion and the underlying drywall so that the flange portion would be effectively concealed.

Preferably, if the flange portion has apertures, the apertures are substantially free of such adhering fibers. Therefore, when pressed onto whichever of the opposite surfaces of the flange portion becomes an outer surface when the drywall-trimming article is used, drywall-finishing material can be thus pressed through the apertures, into intimate contact with the underlying drywall, without intrusion of such adhering fibers. If the apertures were not substantially free of such adhering fibers, such adhering fibers could interfere with bonding between drywall-finishing material pressed through the apertures and the underlying drywall.

If the drywall-trimming article has two flange portions, each of which extends from one of the lateral edges of the elongate portion, it is contemplated by this invention that such adhering fibers do not cover any substantial part of whichever of the opposite surfaces of the flange portions become inner surfaces when the drywall-trimming article. Therefore, the inner surfaces of the flange portions are not separated from the underlying drywall by any added thickness due to such adhering fibers.

This invention is expected to be especially advantageous if embodied in a "bullnose" bead, in which the central portion and each flange portion are extruded unitarily from a polymeric material, such as polyvinyl chloride, so that each flange portion has a thickness in a range from about 0.035 inch to about 0.050 inch and in which the concave surface of the central portion has a radius in a range from about 0.375 inch to about 1.5 inches.

These and other objects, features, and advantages of this invention are evident from the following description of a preferred embodiment of this invention and several alternative embodiments of this invention, as illustrated in the accompanying drawings.

Figure 1:
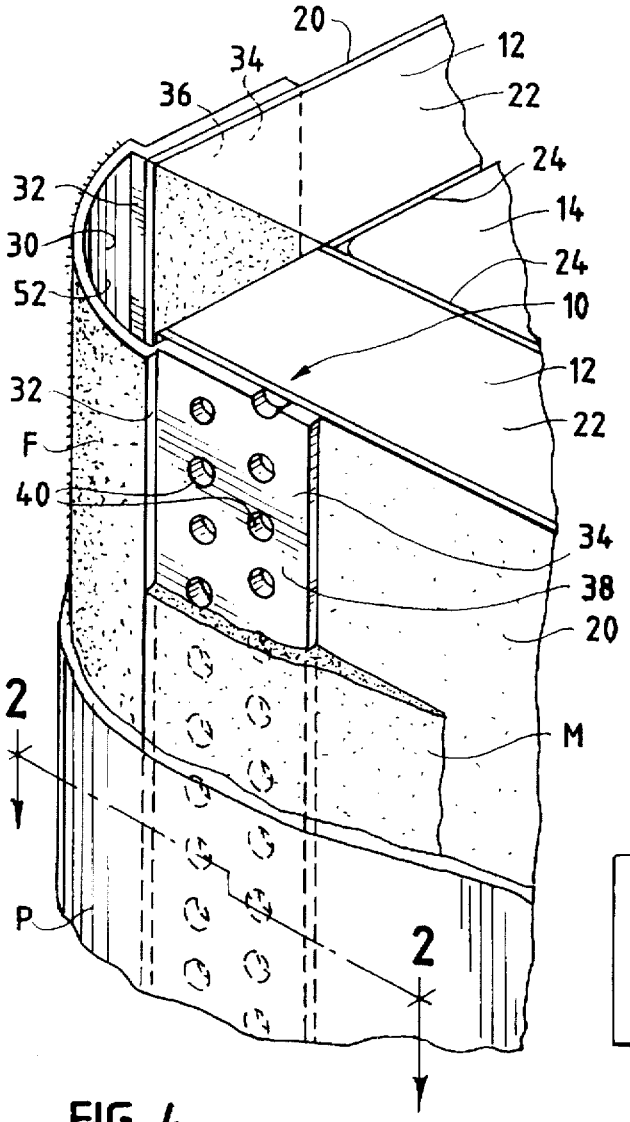
FIG. 1 is a fragmentary, perspective view showing a corner bead constituting a preferred embodiment of this invention and suggesting successive steps in using the corner bead for trimming a vertical corner defined by two drywall panels and a wooden stud.

In the drawings, stippling is used to suggest where certain surfaces of the corner beads or other drywall-trimming articles are substantially covered with discrete fibers, which adhere to the covered surfaces.

DETAILED DESCRIPTION OF THE ILLUSTRATED EMBODIMENTS

Figure 2:
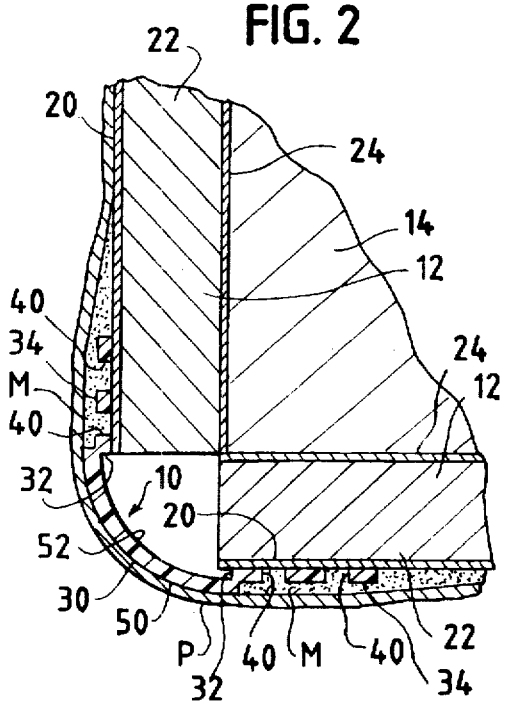
FIG. 2 is a sectional view, which is taken along line 2—2 in FIG. 1, in a direction indicated by arrows.

As shown in FIGS. 1 and 2, a "bullnose" drywall-trimming article of a type that may be conveniently called an outside corner bead 10 exemplifies a drywall-trimming article embodying this invention and constitutes a preferred embodiment of this invention. As shown therein, the outside corner bead 10 is used to trim a vertical corner defined by two drywall panels 12, which are nailed to a wooden stud 14. Conventionally, each drywall panel 12 has an outer paper layer 20, an intermediate gypsum layer 22, and an inner paper layer 24.

The outside corner bead 10 has a unitary body, which is extruded from polyvinyl chloride so as to have an elongate, central portion 30 with two lateral edges 32 and two flange portions 34, each extending from one of the lateral edges 32. As shown in FIGS. 1 and 2, the flange portions 34 diverge from the central portion 30 approximately at a right (90°) angle. Alternatively, the flange portions 34 may diverge from the central portion 30 approximately at a straight (180°) angle or at an obtuse angle between a right angle and a straight angle. Each flange portion 34 has a thickness in a range from about 0.035 inch to about 0.050 inch.

Each flange portion 34 has two broad surfaces, namely a broad surface 36 that becomes an inner surface when the outside corner bead 10 is used and a broad surface 38 that becomes an outer surface when the outside corner bead 10 is used. It is convenient to refer to the broad surface 36 of each flange portion 34 as the inner surface of such flange portion 34 and to refer to the broad surface 38 of each flange portion 34 as the outer surface of such flange portion 34.

As shown in FIGS. 1 and 2, each flange portion 34 is punched so as to have two rows of circular holes 40. Drywall-finishing material M, when pressed onto the outer surfaces 38 of the flange portions 34 when the outside corner bead 10 is used and then finished to a smooth finish with a straight-edged tool (not shown) in a known manner so as to conceal the flange portions 34, can be thus pressed through the holes 40, into intimate contact with the outer paper layers 20 of the drywall panels 12 underlying the inner surfaces 36 of the flange portions 34. When pressed through the holes 40, into intimate contact therewith, such material bonds with and helps to attach the corner bead 10 to the outer paper layers 20 of the underlying panels 12. Conventionally, moreover, the outer surfaces 38 of the flange portions 34 may be pre-primed with a vinyl alkyd texture coat (not shown) to which such material M also bonds.

As shown in FIGS. 1 and 2, the central portion 30 has an arcuate profile, whereby the central portion defines a convex surface 50 and a concave surface 52. When the outside corner bead 10 is used, the convex surface 50 becomes an outer surface of the central portion 30 and the concave surface 52 becomes an inner surface of the central portion 30. The concave surface 52 has a large radius, such as a radius within a range from about 0.375 inch to about 1.5 inches.

As described in the preceding four paragraphs, the outside corner bead 10 is similar to the "bullnose" outside corner beads that heretofore have been available commercially from Trim-Tex, Inc. of Lincolnwood, Ill. and that are shown in its 1996–97 catalog under Stock Nos. 7008, 7009, 7010, 7012 with radii of about 0.75 inch and under Stock Nos. 7098, 7099, 7092 with radii of about 1.5 inches.

According to this invention, the outside corner bead 10 differs from prior drywall-trimming articles including the "bullnose" corner beads mentioned in the immediately preceding paragraph because the convex surface 50 of the central portion 30 is covered substantially with discrete fibers F, which adhere to the substantially covered surface 50 but not to the inner surfaces 36 of the flange portions 34, the outer surfaces 38 of the flange portions 34, or the concave surface 52 of the central portion 30. As suggested in FIG. 1, such adhering fibers F facilitate application of a coat of paint P and texturization of the coat of paint P over the substantially covered surface 50 without separating the inner surfaces 36 of the flanged portions 4 from the underlying panels 12 by any appreciable thickness due to such adhering fibers.

The discrete fibers F, which may be also called floc, may conform essentially in types, diameters, and lengths to the discrete fibers disclosed in Conboy U.S. Pat. No. 5,418,027, the disclosure of which is incorporated herein by reference. Cotton fibers are preferred for the discrete fibers F. The discrete fibers F are applied to the convex surface 50 of the central portion 30 but not to the inner surfaces 36 of the flange portions 34, the outer surfaces 38 of the flange portions 34, or the concave surface 52 of the central portion 30, via a suitable adhesive rolled or sprayed over the convex surface 50 only, by a process that may conform essentially to the process disclosed in Conboy U.S. Pat. No. 5,418,027. Any excess fibers are removed from the inner surfaces 36 of the flange portions 34, the outer surfaces 38 of the flange portions 34, or the concave surface 52 of the central portion 30, and from the holes 40, by brushing or by blowing with pressurized air.

As explained above, a so-called "knocked-down" finish is a texturized finish that results when a painter applies a thick coat of paint with a brush or a roller or with a sprayer, rakes the applied coat of paint with a toothed or serrated tool, and skims raised regions on the raked coat of paint with a straight-edged blade. Because the convex surface 50 would be much harder as compared to drywall-finishing material and to outer paper layers of drywall panels, it would be more difficult for a painter to texturize a coat of paint P covering the convex surface 50 so as to conform to adjacent painted areas if the convex surface 50 were not covered substantially with such adhering fibers F, particularly but not exclusively if a so-called "knocked-down" finish were desired. Since each flange portion 34 has a thickness in a range from about 0.035 inch to about 0.050 inch, and since such adhering fibers F could add an additional thickness from about 0.005 inch to about 0.030 inch or more to each covered surface, it would be highly undesirable for the inner surfaces 36 of the flange portions 34 to be also covered with such adhering fibers F. If the inner surfaces 36 were separated from the underlying panels 12 by any appreciable thicknesses due to such adhering fibers F, it would require more time, labor, and drywall-finishing material M to finish the flange portions 34 and the underlying panels 12 so that the flange portions 34 would be effectively concealed.

According to this invention, moreover, the holes 40 are substantially free of such adhering fibers F. Therefore, when pressed onto the outer surfaces 38 of the flange portions 34 when the outside corner bead 10 is used and then finished to a smooth finish with a straight-edged tool (not shown) in a known manner so as to conceal the flange portions 34, drywall-finishing material M can be thus pressed through the holes 40, into intimate contact with the outer paper layers 20 of the drywall panels 12 underlying the inner surfaces 36 of the flange portions 34. If the holes 40 were not substantially free of such adhering fibers F, such adhering fibers could interfere with bonding between drywall-finishing material M pressed through the holes 40 and the outer paper layers 20 of the underlying panels 12.

Figure 3:
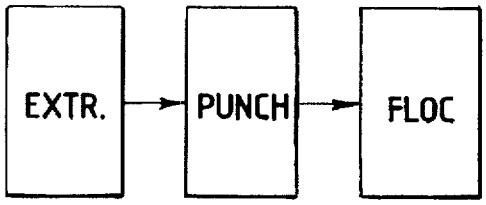
FIG. 3 is a diagram of successive steps in making the corner bead of FIGS. 1 and 2.
Figure 4:
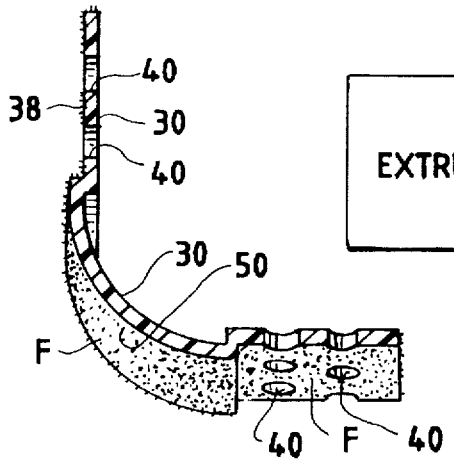
FIG. 4 is a fragmentary, perspective view showing a corner bead constituting an alternative embodiment of this invention.

As suggested in FIG. 3, in one contemplated sequence of steps for making the preferred embodiment of FIGS. 1 and 2, the unitary body of the outside corner bead 10 is extruded, whereupon the holes 40 are punched in the flange portions 40, and whereupon the discrete fibers F are applied to the convex surface 50 of the central portion 30 but not to the inner surfaces 36 of the flange portions 34, the outer surfaces 38 of the flange portions 34, or the concave surface 52 of the central portion 30. As shown in FIG. 4, in an alternative, less preferred embodiment of this invention, the outer surfaces 38 of the flange portions 30 of the outside corner bead 10 may be substantially covered with such adhering fibers F, along with the convex surface 50 of the central portion 30, so long as the holes 40 are substantially free of such adhering fibers F.

Figure 5:
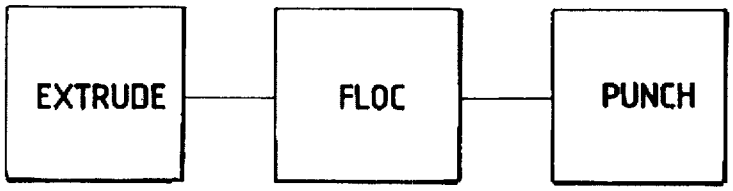
FIG. 5 is a diagram of successive steps in making the corner bead of FIG. 4.

As suggested in FIG. 5, in one contemplated sequence of steps for making the alternative, less preferred embodiment of FIG. 4, the unitary body of the outside corner bead 10 is extruded, whereupon the discrete fibers F are applied to the convex surface 50 of the central portion 30 but not to the inner surfaces 36 of the flange portions 34, the outer surfaces 38 of the flange portions 34, or the concave surface 52 of the central portion 30, and whereupon the holes 40 are punched in the flange portions 40.

Figure 6:
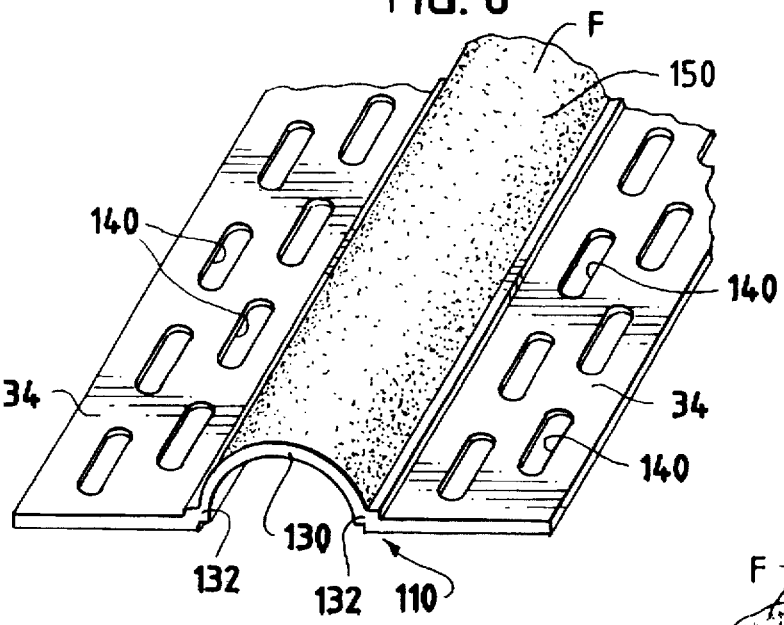
FIGS. 6, 7, and 8 are fragmentary, perspective views showing other drywall-trimming articles constituting other alternative embodiments of this invention.

In another alternative embodiment of this invention, as shown in FIG. 6, a "bullnose" drywall-trimming article 110 of a type that may be conveniently called a wall rail has a unitary body, which is extruded from polyvinyl chloride so as to have a central portion 130 with two lateral edges 132 and two flange portions 134, each extending from one of the lateral edges 132. The flange portions 134 diverge from the central portion 30 approximately at a straight (180°) angle. The central portion 30 has a convex surface 150, which becomes an outer surface when the wall rail 110 is used. The flange portions 134 are punched with two rows of slots 140, which function as the holes 40 function in the outside corner bead 10.

Except that the convex surface 150 of the central portion 130 is substantially covered with such discrete fibers F adhering to the substantially covered surface 150 for purposes of this invention, the wall rail 110 is similar to the so-called "Bull-Rail" articles that heretofore have been available commercially from Trim-Tex, Inc., supra, and that are shown in its 1996–97 catalog under Stock No. 7550. Along with the slots 140, the inner surfaces 136 of the flange portions 134, the outer surfaces 138 of the flange portions 134, and the concave surface 152 of the central portion 130 are substantially free of such adhering fibers F.

Figure 7:
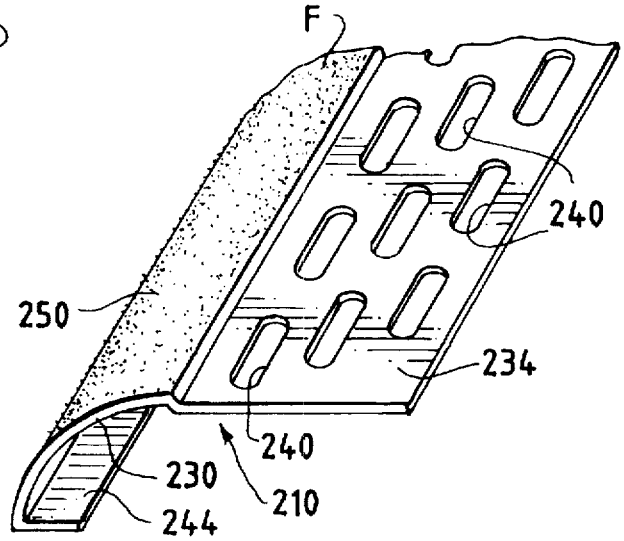
Figure 8:
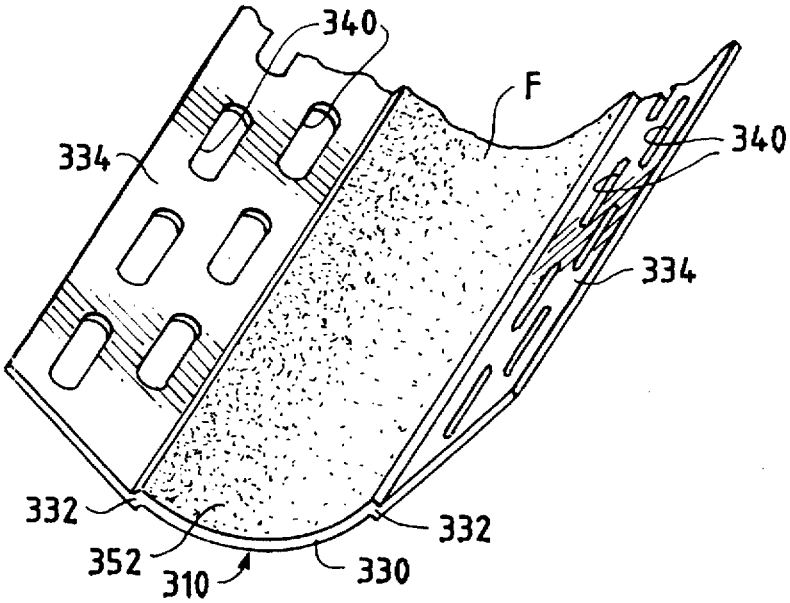

In another alternative embodiment of this invention, as shown in FIG. 7, a "bullnose" drywall-trimming article 210 of a type that may be conveniently called a "J round" has a unitary body, which is extruded from polyvinyl chloride so as to have a central portion 230 with two lateral edges 232, a comparatively wider flange portion 234 extending from one lateral edge 232, and a comparatively narrower flange portion 244 extending from the other edge 232. The comparatively wider flange portion 234 and the comparatively narrow flange portion 244 are parallel to each other and extend in a common direction. The central portion 30 has a convex surface 250, which becomes an outer surface when the wall rail 210 is used. The comparatively wider flange portion 234 is similar to either of the flange portions 34 of the outside corner bead 10, except that the comparatively wider flange portion 234 is punched with three rows of slots 240, rather than with holes like the holes 40. The comparatively narrower flange portion 244 is not punched with holes or slots.

Except that the convex surface 250 is substantially covered with such discrete fibers F adhering to the substantially covered surface 250 for purposes of this invention, the "bullnose" J round 210 is similar to the "bullnose" J rounds that heretofore have been available commercially from Trim-Tex, Inc., supra, and that are shown in its 1996–97 catalog under Stock Nos. 7408, 7410, 7508, 7510. Along with the slots 240, the inner surfaces 236 of the flange portions 234, the outer surfaces 238 of the flange portions 234, and the concave surface 252 of the central portion 230 are substantially free of such adhering fibers F.

In another alternative embodiment of this invention, as shown in FIG. 6, a "bullnose" drywall-trimming article 310 of a type that may be conveniently called an inside corner bead has a unitary body, which is extruded from polyvinyl chloride so as to have a central portion 330 with two lateral edges 332 and two flange portions 334, each extending from one of the lateral edges 332. The flange portions 334 diverge from the central portion 30 approximately at a right (90°) angle. The central portion 30 has a concave surface 352, which becomes an outer surface when the wall rail 330 is used. The flange portions 334 are punched with two rows of slots 340, which function as the holes 40 function in the outside corner bead 30.

Except that the concave surface 352 of the central portion 330 is substantially covered with such discrete fibers F adhering to the substantially covered surface 352 for purposes of this invention, the wall rail 330 is similar to the "bullnose" inside corner beads that heretofore have been available commercially from Trim-Tex, Inc., supra, and that are shown in its 1996–97 catalog under Stock Nos. 7208, 7210, with radii of about 0.75 inch and under Stock Nos. 7062, 7066, 7068 with radii of about 1.5 inches. Along with the slots 340, the inner surfaces 336 of the flange portions 334, the outer surfaces 338 of the flange portions 334, and the convex surface 350 of the central portion 330 are substantially free of such adhering fibers F.

This invention may be also embodied in drywall-trimming article (not shown) of a type known as a two-way or three-way corner, either an inside corner or an outside corner, in which each branch has an elongate, central portion having an arcuate profile and defining a convex surface and a concave surface, in which each branch has two flanged portions, each extending from one of the lateral edges of the elongate, central portion. Ordinarily, in a two-way or three-way corner, the flanged portions are not punched with holes or slots.

Except that whichever of the convex and concave surfaces becomes an outer surface when the two-way or three-way corner is used is substantially covered with discrete particles, which adhere to the substantially covered surface but which do not cover any substantial part of whichever of the opposite surfaces of the flange portions become inner surfaces when the two-way or three-way corner is used, the two-way or three-way corners are similar to the two-way or three-way corners that have been available commercially from Trim-Tex, Inc., supra, and that are shown in its 1996–97 catalog under Stock Nos. 0903, 0904, 0905, 0911, 0912, 0913, 0916, 0915.

Various modifications may be made in the preferred and alternative embodiments described above without departing from the scope and spirit of this invention.

We claim:

1. For trimming a drywall corner, a drywall-trimming article having an elongate portion with two lateral edges, the elongate portion having an arcuate profile, the elongate portion defining a convex surface and a concave surface, the convex surface becoming an outer surface when the drywall-trimming article is used, the drywall-trimming article having a flange portion unitary with the elongate portion, the flange portion having two opposite surfaces, the flange portion extending from one of the lateral edges of the elongate portion, wherein the convex surface defined by the central portion is covered substantially with discrete fibers, which adhere to the substantially covered surface but which do not cover any substantial part of whichever of the opposite surfaces of the flange portion becomes an inner surface when the drywall-trimming article is used, said adhering fibers providing means for facilitating application of a coat of paint and texturization of the coat of paint over the substantially covered surface without separating the inner surface of the flange portion from the underlying drywall by any appreciable thickness due to said adhering fibers.

2. The drywall-trimming article of claim 1 wherein the flange portion has apertures, which are substantially free of said adhering fibers so that drywall-finishing material, when pressed onto whichever of the opposite surfaces of the flange portion becomes an outer surface when the drywall-trimming article is used, can be thus pressed through the apertures, into intimate contact with the underlying drywall, without intrusion of said adhering fibers that could interfere with bonding between such material pressed therethrough and the underlying drywall.

3. A drywall-trimming article having an elongate portion with two lateral edges, the elongate portion having an arcuate profile, the elongate portion defining a convex surface and a concave surface, the concave surface becoming an outer surface when the drywall-trimming article is used, the drywall-trimming article having a flange portion unitary with the elongate portion, the flange portion having two opposite surfaces, the flange portion extending from one of the lateral edges of the elongate portion, wherein the concave surface defined by the central portion is covered substantially with discrete fibers, which adhere to the substantially covered surface but which do not cover any substantial part of whichever of the opposite surfaces of the flange portion becomes an inner surface when the drywall-trimming article is used, said adhering fibers providing means for facilitating application of a coat of paint and texturization of the coat of paint over the substantially covered surface without separating the inner surface of the flange portion from the underlying drywall by any appreciable thickness due to said adhering fibers.

4. The drywall-trimming article of claim 3 wherein the flange portion has apertures, which are substantially free of said adhering fibers so that drywall-finishing material, when pressed onto whichever of the opposite surfaces of the flange portion becomes an outer surface when the drywall-trimming article is used, can be thus pressed through the apertures, into intimate contact with the underlying drywall, without intrusion of said adhering fibers that could interfere with bonding between such material pressed therethrough and the underlying drywall.

5. For trimming a drywall corner, a drywall-trimming article having an elongate portion with two lateral edges, the elongate portion having an arcuate profile, the elongate portion defining a convex surface and a concave surface, the convex surface becoming an outer surface when the drywall-trimming article is used, the drywall-trimming article having two flange portions unitary with the elongate portion, each flange portion having two opposite surfaces, each flange portion extending from one of the lateral edges of the elongate portion, wherein the convex surface defined by the central portion is covered substantially with discrete fibers, which adhere to the substantially covered surface but which do not cover any substantial part of whichever of the opposite surfaces of the flange portions become inner surfaces when the drywall-trimming article is used, said adhering fibers providing means for facilitating application of a coat of paint and texturization of the coat of paint over the substantially covered surface without separating whichever of the opposite surfaces of the flange portions becomes inner surfaces when the drywall-trimming article is used from the underlying drywall by any appreciable thicknesses due to said adhering fibers.

6. The drywall-trimming article of claim 5 wherein the flange portions have apertures, which are substantially free of said adhering fibers so that drywall-finishing material, when pressed onto whichever of the opposite surfaces of the flange portions become outer surfaces when the drywall-trimming article is used, can be thus pressed through the apertures, into intimate contact with the underlying drywall, without intrusion of said adhering fibers that could interfere with bonding between such material pressed therethrough and the underlying drywall.

7. For trimming a drywall corner, a drywall-trimming article having an elongate portion with two lateral edges, the elongate portion having an arcuate profile, the elongate portion defining a convex surface and a concave surface, the concave surface becoming an outer surface when the drywall-trimming article is used, the drywall-trimming article having two flange portions unitary with the elongate portion, each flange portion having two opposite surfaces, each flange portion extending from one of the lateral edges of the elongate portion, wherein the concave surface defined by the central portion is covered substantially with discrete fibers, which adhere to the substantially covered surface but which do not cover any substantial part of whichever of the opposite surfaces of the flange portions become inner surfaces when the drywall-trimming article is used, said adhering fibers providing means for facilitating application of a coat of paint and texturization of the coat of paint over the substantially covered surface without separating whichever of the opposite surfaces of the flange portions becomes inner surfaces when the drywall-trimming article is used from the underlying drywall by any appreciable thicknesses due to said adhering fibers.

8. The drywall-trimming article of claim 7 wherein the flange portions have apertures, which are substantially free of said adhering fibers so that drywall-finishing material, when pressed onto whichever of the opposite surfaces of the flange portions become outer surfaces when the drywall-trimming article is used, can be thus pressed through the apertures, into intimate contact with the underlying drywall, without intrusion of said adhering fibers that could interfere with bonding between such material pressed therethrough and the underlying drywall.

9. The drywall-trimming article of any one of claims 1 through 4 inclusive wherein the central portion and the flange portion are extruded unitarily from a polymeric material and wherein the flange portion has a thickness in a range from about 0.035 inch to about 0.050 inch.

10. The drywall-trimming article of claim 9 wherein the concave surface of the central portion has a radius in a range from about 0.375 inch to about 1.5 inches.

11. The drywall-trimming article of any one of claims 5 through 8 inclusive wherein the central portion and the flange portions are extruded unitarily from a polymeric material and wherein each of the flange portions has a thickness in a range from about 0.035 inch to about 0.050 inch.

12. The drywall-trimming article of claim 11 wherein the concave surface of the central portion has a radius in a range from about 0.375 inch to about 1.5 inches.

13. For trimming a drywall corner, a drywall-trimming article having an elongate portion with two lateral edges, the elongate portion having an arcuate profile, the elongate portion defining a convex surface and a concave surface, the convex surface becoming an outer surface when the drywall-trimming article is used, the drywall-trimming article having a flange portion unitary with the elongate portion, the flange portion having two opposite surfaces, the flange portion extending from one of the lateral edges of the elongate portion, wherein the convex surface defined by the central portion is covered substantially with discrete fibers, which adhere to the substantially covered surface but which do not cover any substantial part of either of the opposite surfaces of the flange portion, said adhering fibers providing means for facilitating application of a coat of paint and texturization of the coat of paint over the substantially covered surface without separating the inner surface of the flange portion from the underlying drywall by any appreciable thickness due to said adhering fibers.

14. A drywall-trimming article having an elongate portion with two lateral edges, the elongate portion having an arcuate profile, the elongate portion defining a convex surface and a concave surface, the concave surface becoming an outer surface when the drywall-trimming article is used, the drywall-trimming article having a flange portion unitary with the elongate portion, the flange portion having two opposite surfaces, the flange portion extending from one of the lateral edges of the elongate portion, wherein the concave surface defined by the central portion is covered substantially with discrete fibers, which adhere to the substantially covered surface but which do not cover any substantial part of either of the opposite surfaces of the flange portion, said adhering fibers providing means for facilitating application of a coat of paint and texturization of the coat of paint over the substantially covered surface without separating the inner surface of the flange portion from the underlying drywall by any appreciable thickness due to said adhering fibers.

15. For trimming a drywall corner, a drywall-trimming article having an elongate portion with two lateral edges, the elongate portion having an arcuate profile, the elongate portion defining a convex surface and a concave surface, the convex surface becoming an outer surface when the drywall-trimming article is used, the drywall-trimming article having two flange portions unitary with the elongate portion, each flange portion having two opposite surfaces, each flange portion extending from one of the lateral edges of the elongate portion, wherein the convex surface defined by the central portion is covered substantially with discrete fibers, which adhere to the substantially covered surface but which do not cover any substantial part of either of the opposite surfaces of the flange portions, said adhering fibers providing means for facilitating application of a coat of paint and texturization of the coat of paint over the substantially covered surface without separating whichever of the opposite surfaces of the flange portions becomes inner surfaces when the drywall-trimming article is used from the underlying drywall by any appreciable thicknesses due to said adhering fibers.

16. For trimming a drywall corner, a drywall-trimming article having an elongate portion with two lateral edges, the elongate portion having an arcuate profile, the elongate portion defining a convex surface and a concave surface, the concave surface becoming an outer surface when the drywall-trimming article is used, the drywall-trimming article having two flange portions unitary with the elongate portion, each flange portion having two opposite surfaces, each flange portion extending from one of the lateral edges of the elongate portion, wherein the concave surface defined by the central portion is covered substantially with discrete fibers, which adhere to the substantially covered surface but which do not cover any substantial part of either of the opposite surfaces of the flange portions, said adhering fibers providing means for facilitating application of a coat of paint and texturization of the coat of paint over the substantially covered surface without separating whichever of the opposite surfaces of the flange portions becomes inner surfaces when the drywall-trimming article is used from the underlying drywall by any appreciable thicknesses due to said adhering fibers.

17. The drywall-trimming article of any one of claims 13, 14, 15, and 16 wherein the flange portions have apertures, which are substantially free of said adhering fibers so that drywall-finishing material, when pressed onto whichever of the opposite surfaces of the flange portions become outer surfaces when the drywall-trimming article is used, can be thus pressed through the apertures, into intimate contact with the underlying drywall, without intrusion of said adhering fibers that could interfere with bonding between such material pressed therethrough and the underlying drywall.

* * * * *